US009851167B2

(12) United States Patent
Smith

(10) Patent No.: US 9,851,167 B2
(45) Date of Patent: Dec. 26, 2017

(54) SWITCH BARREL RECOIL LUG

(71) Applicant: Clayton Dean Smith, Ackerly, TX (US)

(72) Inventor: Clayton Dean Smith, Ackerly, TX (US)

( * ) Notice: Subject to any disclaimer, the term of this patent is extended or adjusted under 35 U.S.C. 154(b) by 0 days.

(21) Appl. No.: 15/439,852

(22) Filed: Feb. 22, 2017

(65) Prior Publication Data

US 2017/0268844 A1 Sep. 21, 2017

Related U.S. Application Data

(60) Provisional application No. 62/308,760, filed on Mar. 15, 2016.

(51) Int. Cl.
*F41A 21/48* (2006.01)
*F41A 3/66* (2006.01)

(52) U.S. Cl.
CPC ..... *F41A 21/487* (2013.01); *F41A 3/66* (2013.01)

(58) Field of Classification Search
CPC .. F41A 3/66; F41A 21/00; F41A 21/48; F41A 21/484; F41A 21/487
USPC ..... 42/75.01, 76.01; 89/14.05
See application file for complete search history.

(56) References Cited

U.S. PATENT DOCUMENTS 1,065,341 A * 6/1913 Browning ..... F41A 11/04 42/1.07
1,194,024 A 8/1916 Johnson
2,155,498 A 4/1939 Laudensack
2,702,958 A * 3/1955 Boroszewsi ..... F41A 21/485 42/75.01
3,336,691 A * 8/1967 Allyn ..... F41A 3/32 42/16
3,731,418 A 5/1973 Birkenhagen et al.
3,883,977 A 5/1975 McClure
4,429,614 A 2/1984 Tocco
4,791,748 A 12/1988 Leskinen
7,451,564 B2 11/2008 Wait
7,905,041 B1 * 3/2011 Davies ..... F41A 3/66 42/75.02
7,975,417 B2 7/2011 Duplessis et al.
8,079,169 B2 12/2011 Gregg
8,230,633 B1 7/2012 Sisk
8,910,408 B2 12/2014 Masters et al.
9,234,717 B2 1/2016 Jarboe
2005/0229463 A1 10/2005 Tashjian
2009/0077855 A1 * 3/2009 Pritchett ..... F41G 11/003 42/90
2011/0061281 A1 * 3/2011 Kapusta ..... F41C 23/16 42/71.01
2012/0311908 A1 * 12/2012 Kenney ..... F41A 21/482 42/75.02
2013/0219765 A1 8/2013 Ibarguren
(Continued)

*Primary Examiner* — Bret Hayes
(74) *Attorney, Agent, or Firm* — Lewis Roca Rothgerber Christie LLP

(57) ABSTRACT

A switch barrel recoil lug for clamping together a rifle action and a rifle barrel having a body with a barrel shank bore hole and a split section allowing expansion and contraction of the barrel shank bore hole, an index pin hole or threaded holes for aligning and connecting the body to the rifle action and a stock flange for engaging a rifle stock wherein the barrel shank bore hole has a tapered surface matching a tapered surface on a barrel shank of the rifle barrel.

13 Claims, 4 Drawing Sheets

(56) References Cited

U.S. PATENT DOCUMENTS

| | | | | |
|---|---|---|---|---|
| 2014/0115938 | A1* | 5/2014 | Jarboe | F41A 21/485<br>42/71.01 |
| 2015/0369555 | A1* | 12/2015 | Daniel | F41A 21/485<br>42/75.02 |
| 2016/0033226 | A1* | 2/2016 | Potter | F41A 3/30<br>42/76.01 |
| 2017/0227312 | A1* | 8/2017 | Christensen | F41A 9/65 |

* cited by examiner

SWITCH BARREL RECOIL LUG

CROSS-REFERENCE TO RELATED APPLICATION(S)

This application claims priority to and the benefit of U.S. Provisional Patent Application No. 62/308,760 filed Mar. 15, 2016, the entire contents thereof are incorporated herein by reference.

FIELD OF THE INVENTION

This invention relates in general to firearms, in particular bolt action rifles having interchangeable barrels, and more particularly to a recoil lug designed to allow the user of the firearm to change barrels under field conditions with repeatable accuracy and a minimum number of tools.

BACKGROUND OF THE INVENTION

Depending upon the type of game being hunted or the conditions in which a hunter is pursuing the game, different caliber ammunition can be required. Consequently to accommodate different caliber ammunition, a hunter must carry a number of different firearms which can be inconvenient. Consequently rifles have been developed with a single action and stock that will accept a variety of different barrels thereby eliminating the need to carry separate firearms. In these instances, interchangeable rifle barrels of different calibers can be conveniently carried by the hunter. The interchangeable rifle barrels have different caliber bores as desired.

As can be appreciated, changing barrels on a firearm must be done precisely and accurately to avoid issues with firearm performance. Prior firearm designs included complicated constructions to provide accuracy and compatibility or the need for complicated or specialized tools to exchange the barrels. One can appreciate that it would be desirable for a hunter in the field to have a rifle design which can provide repeatable accuracy for changing the barrel and can be done with a minimum number of tools. Consequently a need exists for a firearm having a switch barrel recoil lug which can provide the user to change barrels under field conditions with repeatable accuracy and a minimum number of tools.

SUMMARY OF THE INVENTION

The present invention is directed to a switch barrel recoil lug for a bolt action rifle having interchangeable barrels which allows the user to change barrels under field conditions with repeatable accuracy and a minimum number of tools. The switch barrel recoil lug of the present invention is positioned between a face of a rifle action and a torque shoulder of the rifle barrel and replaces a standard recoil lug and therefore acts as both a recoil lug and a barrel clamping system. The switch barrel recoil lug of the present invention can include various embodiments, and for example, includes a body portion having a rifle barrel shank bore and a stock flange extending below the rifle action. The body portion is solid having front and back surfaces machined parallel to each other. The stock flange allows the lug to be properly fitted to the rifle stock for optimum accuracy and prevents flexing of the lug under recoil stress when the rifle is fired.

The switch barrel recoil lug has a clamping system which can include a split flange on a top portion of the lug to allow expansion and contraction of the lug around the barrel shank. A single screw extends through a threaded bore in the split top flange on an axis perpendicular to the barrel axis. The barrel shank bore through the recoil lug, through which the barrel passes, is larger in diameter than the diameter of the barrel shank so that the shank can pass through the lug freely when the clamp screw is loose.

The barrel of the rifle is threaded into the rifle action on one end and hand tightened against the face of the recoil lug. Once the barrel is hand tight, the clamp screw is tightened which contracts the sides of the lug against the barrel shank. The clamping force of the lug holds the barrel securely in place and prevents loosening of the barrel from the rifle action. In one configuration, the barrel shank bore hole in the recoil lug can be machined flat or in another embodiment, is machined with a tapered surface that increases in diameter toward the front face of the lug. In this embodiment, the barrel shank is also machined with a matching tapered surface. The tapered bore surface exerts a multidirectional force on the barrel shank when the clamp screws are tightened, forcing the external threads on the barrel shank into more positive contact with the internal threads of the rifle action. The tapered surface also helps with an alignment of the barrel to the rifle action when the recoil lug is clamped thereby providing an increase in repeatability of point of impact when the rifle is fired.

The recoil lug is aligned to the rifle action by the use of index pins or other alignment fasteners. These and other aspects of the present invention will be more clearly understood by reference to the following detailed description and accompanying drawings.

DETAILED DESCRIPTION

Figure 1A:
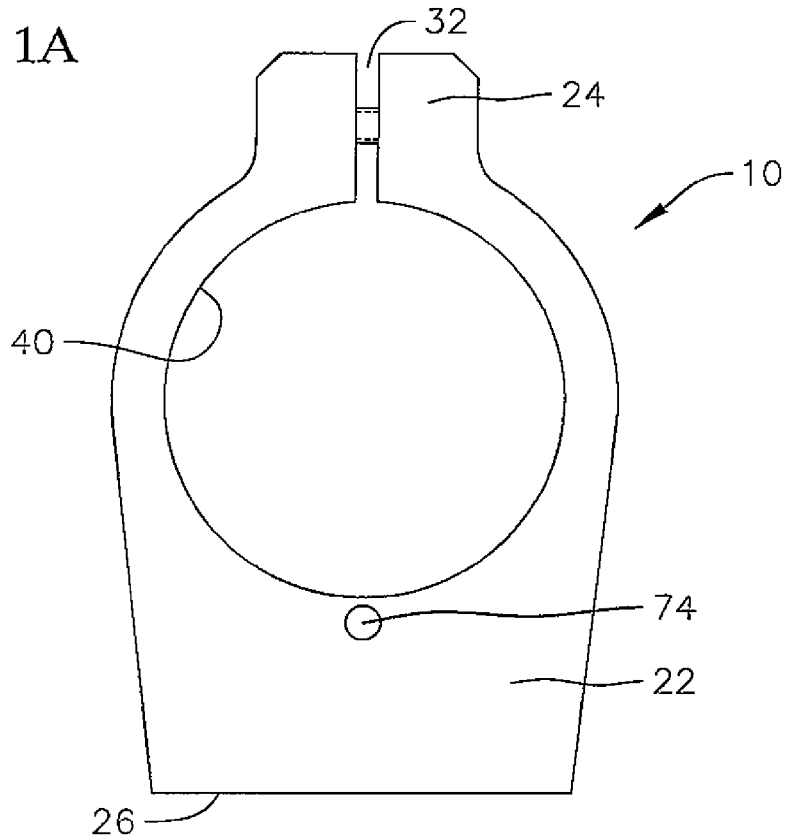
FIG. 1A is a front view of a switch barrel recoil lug of the present invention.

Referring to FIGS. 1A and 2-4, the present invention is directed to a switch barrel recoil lug 10 for use between a rifle action 12 and a barrel 14 of a bolt action rifle. The recoil lug allows for the ability to switch barrels under field conditions with repeatable accuracy and a minimum number of tools. The recoil lug is positioned between a face 16 of the rifle action and a torque shoulder 18 of the rifle barrel. The switch barrel recoil lug replaces a standard recoil lug and acts as both a recoil lug and a barrel clamping system. The switch barrel recoil lug has a barrel face 20 and a rifle action face 22 that are parallel to each other. The switch barrel recoil lug has a split top flange 24 and a lower rifle stock flange 26. The lower stock flange protrudes below the rifle action and fits within a groove 28 formed in the stock 30. The stock flange 26 provides for proper fitting to the rifle stock for optimum accuracy and prevents flexing of the recoil lug under recoil stress when the rifle is fired.

In the embodiment illustrated in FIG. 1A the top flange 24 is machined with a split section 32 extending therethrough to allow expansion and contraction of the recoil lug around the barrel shank 34. The top flange has a threaded bore 36 extending on either side of the split 32 for receipt of a threaded bolt 38. The bolt extends through the threaded bore on an axis perpendicular to the barrel axis. The recoil lug has a barrel shank bore hole 40 extending therethrough, through which the barrel shank 34 passes and is machined slightly larger than the diameter of the barrel shank so that the shank can pass through freely when the clamp bolt 38 is loose. The end 42 of the barrel is threaded for engagement in the threaded end 44 of the rifle action. As indicated, the barrel shank bore hole of the recoil lug has a larger diameter than the barrel shank allowing the barrel to be threaded into the rifle action. The threaded end of the barrel is threaded into the threaded end of the rifle action and hand tightened against the barrel face of the recoil lug thereby contacting the rifle action face of the recoil lug against the end face of the rifle action. Once the barrel is hand tightened, the clamp bolt is also tightened which contracts the barrel shank bore against the barrel shank. The clamping force of the recoil lug holds the barrel securely in place and prevents loosening of the barrel from the rifle action.

Figure 1B:
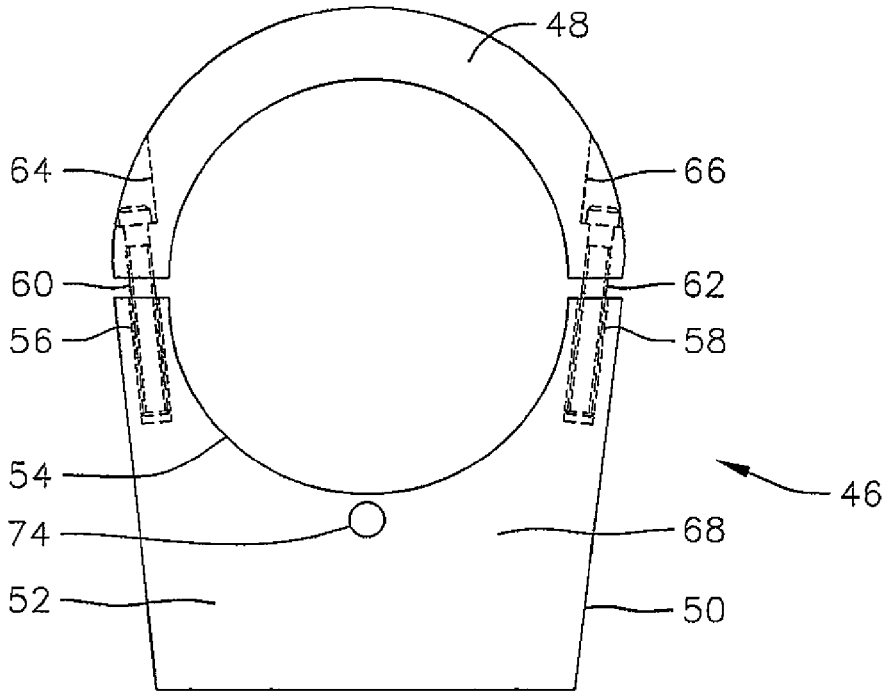
FIG. 1B is a front view of an alternative embodiment switch barrel recoil lug of the present invention.

As shown in FIG. 1B, an alternative embodiment switch barrel recoil lug 46 is illustrated. In this embodiment, the recoil lug is machined as a two piece component having an upper portion 48 and a lower portion 50. The lower portion 50 includes a stock flange 52 for similarly fitting within groove 28 of the stock. Recoil lug 46 has a barrel shank bore hole 54 positioned therein. Threaded holes 56 and 58 are positioned on either side of the barrel bore hole for receipt of clamp bolts 60 and 62 extending through threaded holes 64 and 66 in top portion 48. Top portion 48 moves freely in the vertical direction when the clamp bolts are loose. With the clamp bolts loose, the barrel can be inserted through the barrel shank bore hole into the rifle action and hand tightened against the barrel face 68 of the recoil lug. Clamp bolt 60 and 62 are then tightened which contracts the top section of the recoil lug against the barrel shank 34. The clamping force of the recoil lug holds the barrel securely in place and prevents loosening of the barrel from the rifle action.

Figure 3:
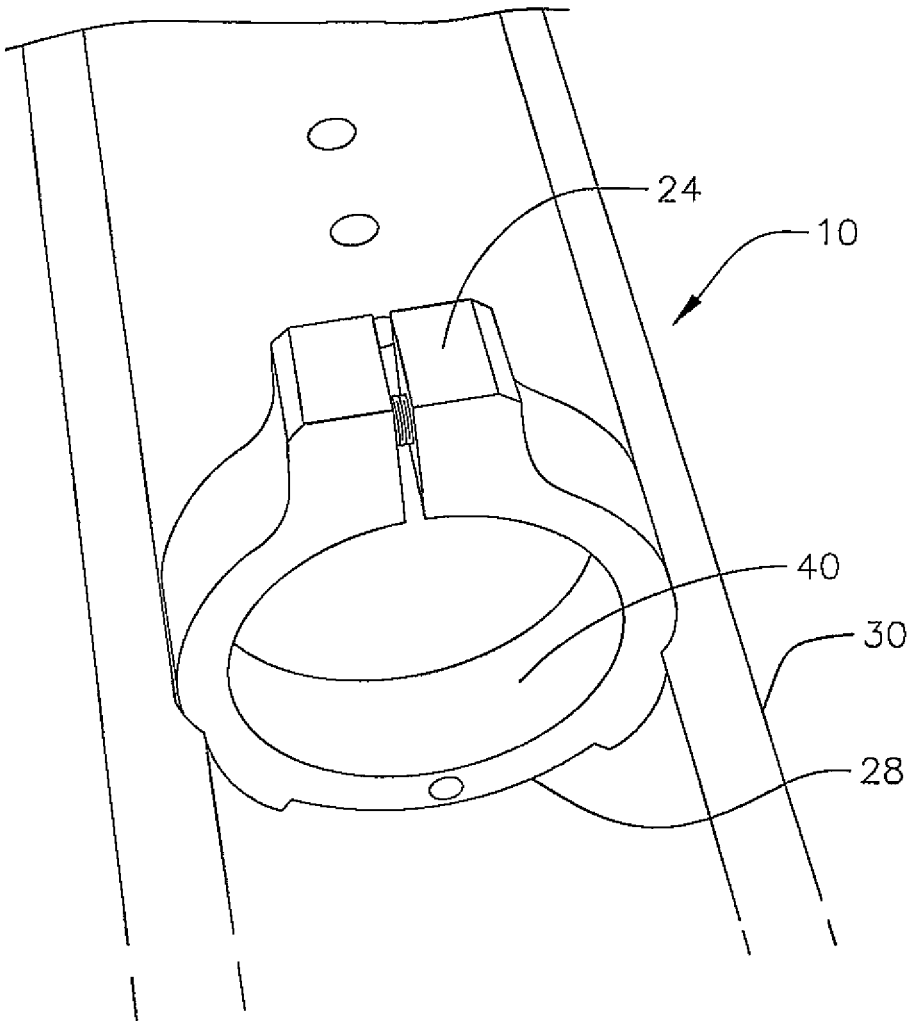
FIG. 3 is an end perspective view of the switch barrel recoil lug of FIG. 1A installed on the rifle action and in the stock of the rifle with the barrel removed.
Figure 4:
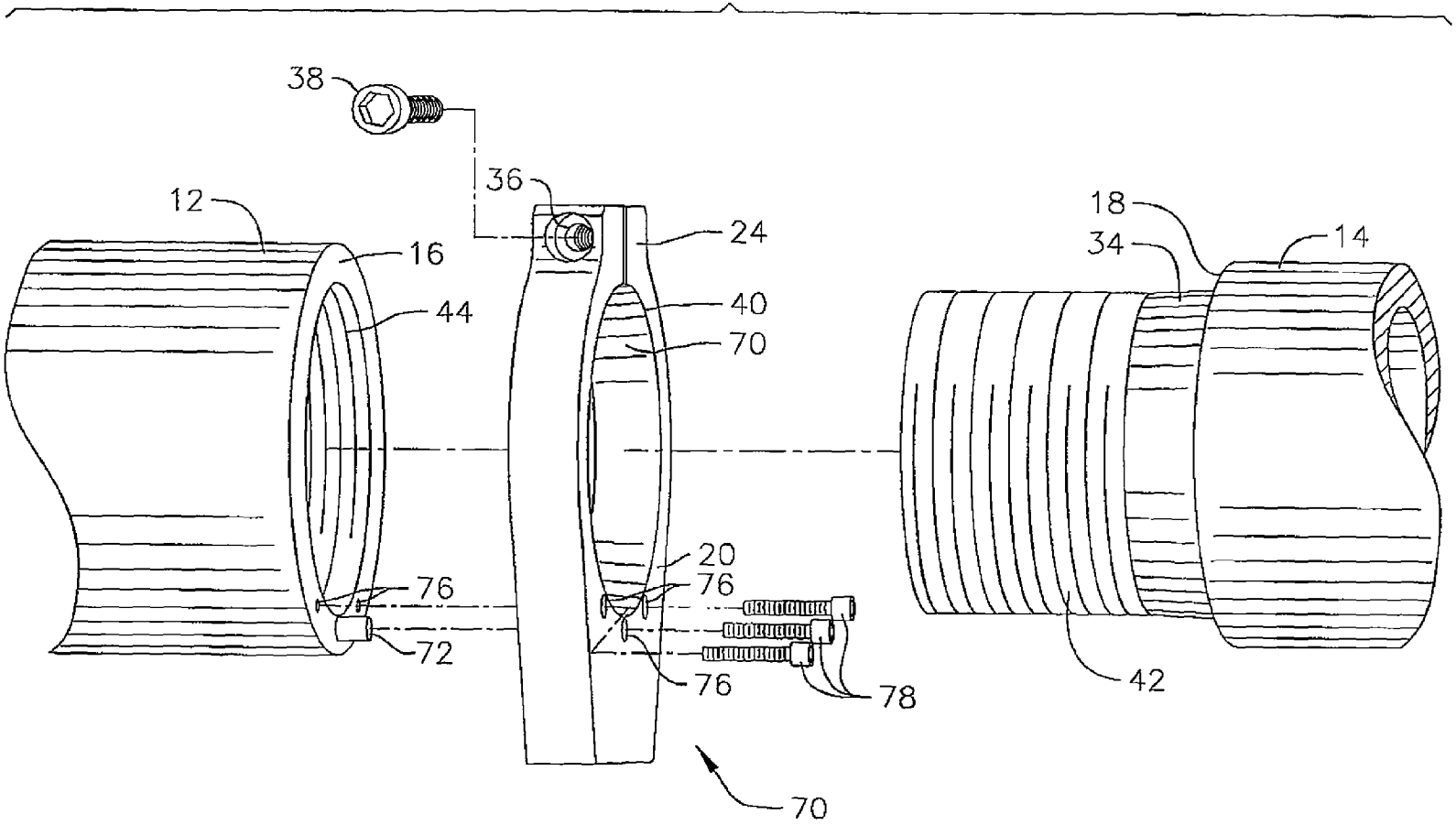
FIG. 4 is an exploded perspective view of the switch barrel recoil lug of FIG. 3 illustrating the tapered rifle barrel shank bore.

As shown in FIG. 3 the barrel shank bore hole in the recoil lug through which the barrel shank passes can be flat or with a tapered surface 70 as shown in FIG. 4. The tapered surface 70 increases in diameter toward the barrel side surface of the recoil lug. In this configuration barrel shank 34 is also machined with a matching tapered surface. Tapered bore surface 70 exerts a multidirectional force on the barrel shank when the recoil lug is tightened, forcing the external threads on the barrel shank into more positive contact with the internal threads of the rifle action. The tapered surface also helps with alignment of the barrel within the rifle action when clamped providing an increase in repeatability of point of impact when the rifle is fired.

The switch barrel recoil lug can be aligned to the rifle action 12 by a steel index pin 72 which is press fit into the end 16 of the rifle action. Index pin 72 is received within an index hole 74 extending into the rifle action face 22 of the recoil lug. Although a single index pin positioned at six o'clock as illustrated in the drawings, it is to be understood that multiple pins separated from one another could be incorporated. The index pin serves both to align the lug to the barrel tenon threads of the rifle action, and also to prevent lateral movement of the lug during tightening or loosening of the rifle barrel. As previously indicated, forward movement of the lug is prevented by precisely fitting the stock flange to the rifle stock. Once the recoil lug has been installed onto the rifle action and the barrel is tightened in place the rifle action and lug are bedded into the stock with a bedding compound such as Devcon, Acra-Glas or Marine Tex. Once properly fitted to the rifle action and stock, the clamp portion of the recoil lug can be operated properly with no lateral or forward movement of the recoil lug.

Figure 2:
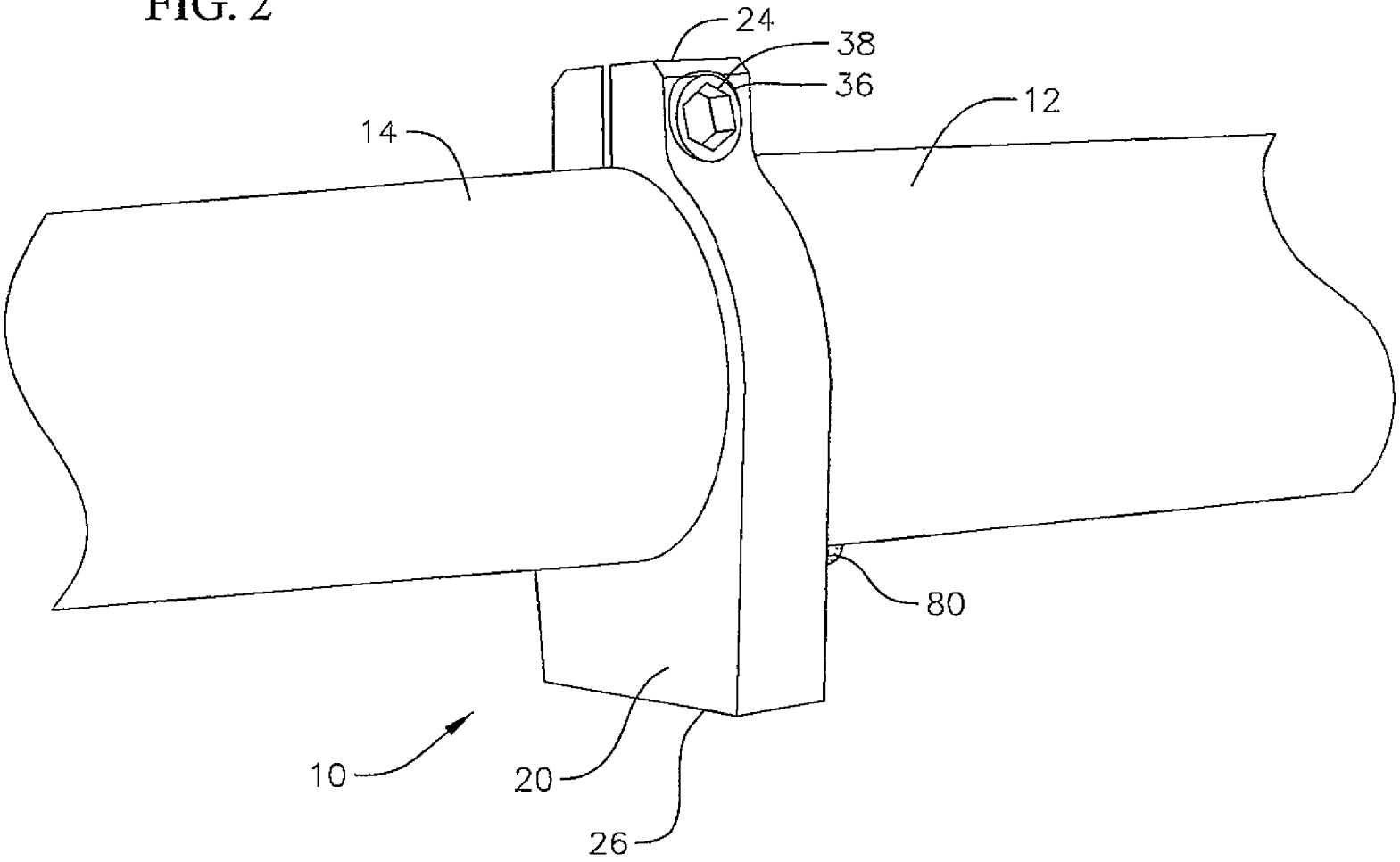
FIG. 2 is perspective view of the switch barrel recoil lug of FIG. 1A installed between a rifle action and rifle barrel.

FIG. 4 illustrates an alternative method to secure the recoil lug to the rifle action wherein threaded holes 76 can be machined through the recoil lug and also threaded holes 76 can be machined into the end face of the rifle action. The recoil lug could then be attached by means of threaded screws with countersunk or counter bored heads so that they do not protrude into the contact area for the barrel shank torque shoulder. Screws 78 would need to be coated with a thread locking adhesive during installation to guard against loosening from vibration over time. Given the minimal area between the index holes and the barrel shank bore hole for the barrel shank, once the screws are installed the portion of the screw heads that may protrude into the barrel bore hole would be machined flush with the inside diameter of the barrel shank bore hole. As shown in FIG. 2, further alternatively, the switch barrel recoil lug could be welded to the rifle action along a bottom seam 80. This could be accomplished by TiG welding with an appropriate filler rod. For instances of welding, the rifle stock would be inletted in the corresponding area for clearance of the seam so that the rifle action face of the recoil lug is in full contact with the stock bearing surface.

Although the present invention has been described and illustrated with multiple embodiments thereof, it is to be understood that other modifications could be made therein which are within the full intended scope of the invention as hereinafter claimed.

What is claimed is:

1. A switch barrel recoil lug for clamping together a rifle action and a rifle barrel comprising:

a body having a barrel shank bore hole and at least one split section allowing expansion and contraction of the barrel shank bore hole;

means for aligning and connecting the body to the rifle action; and a stock flange for engaging a rifle stock, wherein the barrel shank bore hole has a tapered surface matching a mating tapered surface on a barrel shank of the rifle barrel.

2. The recoil lug of claim 1 wherein the means for aligning and connecting the body to the rifle action include an index pin hole for receipt of an index pin on the rifle action.

3. The recoil lug of claim of claim 1 wherein the means for aligning and connecting the body to the rifle action include at least one threaded hole through the body and the rifle action for receipt of a threaded screw.

4. The recoil lug of claim 1 wherein the split section of the body includes a top flange having a threaded bore and a clamping bolt positioned in the threaded bore.

5. The recoil lug of claim 1 wherein the split section of the body includes a top portion and a separate bottom portion spaced from the top portion, each having aligned threaded bores on either side of the barrel shank bore hole for receipt of a clamping bolt.

6. A switch barrel recoil lug for clamping together a rifle action and a rifle barrel comprising:

a body portion having a barrel shank bore hole extending therethrough;

a top flange portion extending above the body portion having a split section extending into the barrel shank bore hole, the top flange portion having a threaded bore extending therethrough and a threaded bolt positioned in the threaded bore to expand and contract a diameter of the barrel shank bore hole;

means for aligning and connecting the body portion to the rifle action; and a stock flange portion extending below the body portion for engaging a rifle stock.

7. The recoil lug of claim 6 wherein the means for aligning and connecting the body portion to the rifle action includes an index pin hole for receipt of an index pin on the rifle action.

8. The recoil lug of claim 6 wherein the means for aligning and connecting the body portion to the rifle action includes at least one threaded hole extending through the body portion and the rifle action for receipt of a threaded screw.

9. The recoil lug of claim 6 wherein the barrel shank bore hole has a tapered surface for engaging a mating tapered surface on a barrel shank of the rifle barrel.

10. A switch barrel recoil lug for clamping together a rifle action and a rifle barrel comprising:

a top body portion;

a separate body portion spaced from the top body portion;

the top body portion and the bottom body portion forming a barrel shank bore hole for receipt of a barrel shank of the rifle barrel;

the top body portion and the bottom body portion having an aligned threaded hole on either side of the barrel shank bore hole for receipt of a clamping screw;

means for aligning and connecting the bottom body portion to the rifle action; and a stock flange portion extending below the bottom body portion for engaging a rifle stock.

11. The recoil lug of claim 10 wherein the means for aligning and connecting the bottom body portion to the rifle action includes an index pin hole for receipt of an index pin on the rifle action.

12. The recoil lug of claim 10 wherein the means for aligning and connecting the bottom body portion to the rifle action include at least one threaded hole extending through the bottom body portion for receipt of a threaded screw.

13. The recoil lug of claim 10 wherein the barrel shank bore hole has a tapered surface for engaging a mating tapered surface on the barrel shank.

* * * * *